US006520177B1

(12) United States Patent
Bonhomme et al.

(10) Patent No.: US 6,520,177 B1
(45) **Date of Patent: *Feb. 18, 2003**

(54) DEVICE FOR PROVIDING PROTECTION AGAINST HYPOXIA, USABLE IN A HOSTILE ENVIRONMENT

(75) Inventors: Jean-Philippe Bonhomme, Versailles (FR); Jean-Claude Urgel, Le Chesnay (FR)

(73) Assignee: Intertechnique, Plaisir (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/094,498

(22) Filed: Jun. 10, 1998

(30) Foreign Application Priority Data

Jun. 10, 1997 (FR) ..... 97 07162

(51) Int. Cl.[7] ..... A62B 18/10

(52) U.S. Cl. ..... 128/201.28; 128/201.22; 128/201.23; 128/201.24; 128/201.25; 128/201.29; 128/205.24; 128/206.23; 128/207.11

(58) Field of Search ..... 128/201.22, 201.23, 128/201.25, 201.29, 206.23, 206.27, 206.28, 207.11, 201.24, 201.18, 201.12, 201.15, 201.28, 202.28, 205.25, 205.27, 205.29; 2/6.2

(56) References Cited

U.S. PATENT DOCUMENTS

| | | | | | |
|---|---|---|---|---|---|
| 817,075 | A | * | 4/1906 | Lavis | 128/201.24 |
| 1,395,759 | A | * | 11/1921 | Monro | 128/206.28 |
| 2,365,779 | A | * | 12/1944 | Schwab | 128/201.14 |
| 2,473,518 | A | * | 6/1949 | Garrard et al. | 128/205.24 |
| 2,597,764 | A | * | 5/1952 | Tucker et al. | 128/201.24 |
| 2,827,900 | A | * | 3/1958 | Marietta | 128/201.24 |
| 2,882,896 | A | * | 4/1959 | Seeler | 128/201.24 |
| 3,353,534 | A | * | 11/1967 | Savoie | 128/201.24 |
| 3,680,555 | A | * | 8/1972 | Warncke | 128/202.22 |
| 3,716,053 | A | * | 2/1973 | Almovist et al. | 128/205.25 |
| 3,774,239 | A | * | 11/1973 | Kotzar | 2/10 |
| 4,215,437 | A | * | 8/1980 | Kao | 2/424 |
| 4,276,877 | A | * | 7/1981 | Gdulla | 128/200.27 |
| 4,315,335 | A | | 2/1982 | Kennedy et al. | 2/424 |
| 4,352,353 | A | * | 10/1982 | Bolton et al. | 128/201.24 |
| 4,378,011 | A | * | 3/1983 | Warncke et al. | 128/204.26 |
| 4,430,995 | A | * | 2/1984 | Hilton | 128/204.21 |
| 4,440,164 | A | * | 4/1984 | Werjefelt | 128/205.25 |
| 4,462,119 | A | * | 7/1984 | Rudd | 2/424 |
| 4,494,538 | A | * | 1/1985 | Ansite | 128/205.25 |
| 4,522,639 | A | * | 6/1985 | Ansite et al. | 55/314 |
| 4,574,799 | A | * | 3/1986 | Warncke | 128/206.24 |
| 4,608,976 | A | * | 9/1986 | Suchy | 128/204.26 |
| 4,764,990 | A | * | 8/1988 | Market | 2/429 |
| 4,799,476 | A | * | 1/1989 | McGrady | 128/202.11 |
| 4,875,477 | A | * | 10/1989 | Waschke et al. | 128/206.21 |
| 4,905,683 | A | * | 3/1990 | Cronjager | 128/202.22 |
| H863 | H | * | 1/1991 | Kwiedorowicz et al. | 2/424 |

(List continued on next page.)

FOREIGN PATENT DOCUMENTS

| | | | | |
|---|---|---|---|---|
| EP | 0090083 | | 11/1982 | |
| EP | 0705622 | | 4/1996 | |
| GB | 2266467 | | 4/1992 | |
| GB | 2266669 | A * | 11/1993 | 128/201.12 |

*Primary Examiner*—Aaron J. Lewis
*Assistant Examiner*—Joseph F. Weiss
(74) *Attorney, Agent, or Firm*—Larson & Taylor PLC

(57) ABSTRACT

The device has a face cover, a mouth-and-nose mask, and fasteners for holding the face cover on the face. The face cover is provided with a flexible gasket surrounding the eyes, a sea means at its periphery, and a closable coupling to a filtered gas feed. The mouth-and-nose mask, placed inside the face cover, is fitted with a demand regulator and with a direct exhaust to atmosphere. The breathe-in and breathe-out paths are separated by cases.

6 Claims, 4 Drawing Sheets

U.S. PATENT DOCUMENTS

| | | | | | |
|---|---|---|---|---|---|
| 5,078,130 | A | | 1/1992 | Van Oosten et al. | 128/201.24 |
| 5,111,809 | A | * | 5/1992 | Gamble et al. | 128/204.18 |
| 5,181,506 | A | * | 1/1993 | Tardiff, Jr. et al. | 128/201.22 |
| 5,263,477 | A | * | 11/1993 | Crome | 128/205.24 |
| 5,318,018 | A | * | 6/1994 | Puma et al. | 128/202.11 |
| 5,322,059 | A | * | 6/1994 | Walther | 128/205.23 |
| 5,349,949 | A | * | 9/1994 | Schegerin | 128/201.24 |
| H1360 | H | * | 10/1994 | Grove et al. | 128/201.25 |
| H1361 | H | * | 10/1994 | Tardiff, Jr. et al. | 128/206.12 |
| 5,411,021 | A | * | 5/1995 | Gdulla et al. | 128/206.28 |
| 5,431,156 | A | * | 7/1995 | Sundstrom | 128/201.23 |
| 5,477,850 | A | * | 12/1995 | Zegler | 128/202.11 |
| 5,488,948 | A | | 2/1996 | Dubruille et al. | 128/207.11 |
| 5,515,843 | A | * | 5/1996 | Chang | 128/201.25 |
| 5,540,218 | A | * | 7/1996 | Jones et al. | 128/201.24 |
| 5,555,569 | A | * | 9/1996 | Lane | 2/424 |
| 5,575,278 | A | * | 11/1996 | Bonhomme et al. | 128/201.29 |
| 5,577,496 | A | * | 11/1996 | Blackwood et al. | 128/201.25 |
| 5,649,532 | A | * | 7/1997 | Griffiths | 128/206.24 |
| 5,653,225 | A | * | 8/1997 | Schegerin | 128/201.22 |
| 5,704,073 | A | * | 1/1998 | Sword et al. | 128/206.23 |
| 6,161,538 | A | * | 12/2000 | Bonhomme et al. | 128/204.21 |
| 6,245,009 | B1 | * | 6/2001 | Travis et al. | 600/20 |
| 6,328,031 | B1 | * | 12/2001 | Tischer et al. | 128/201.25 |

* cited by examiner

FIG.4.
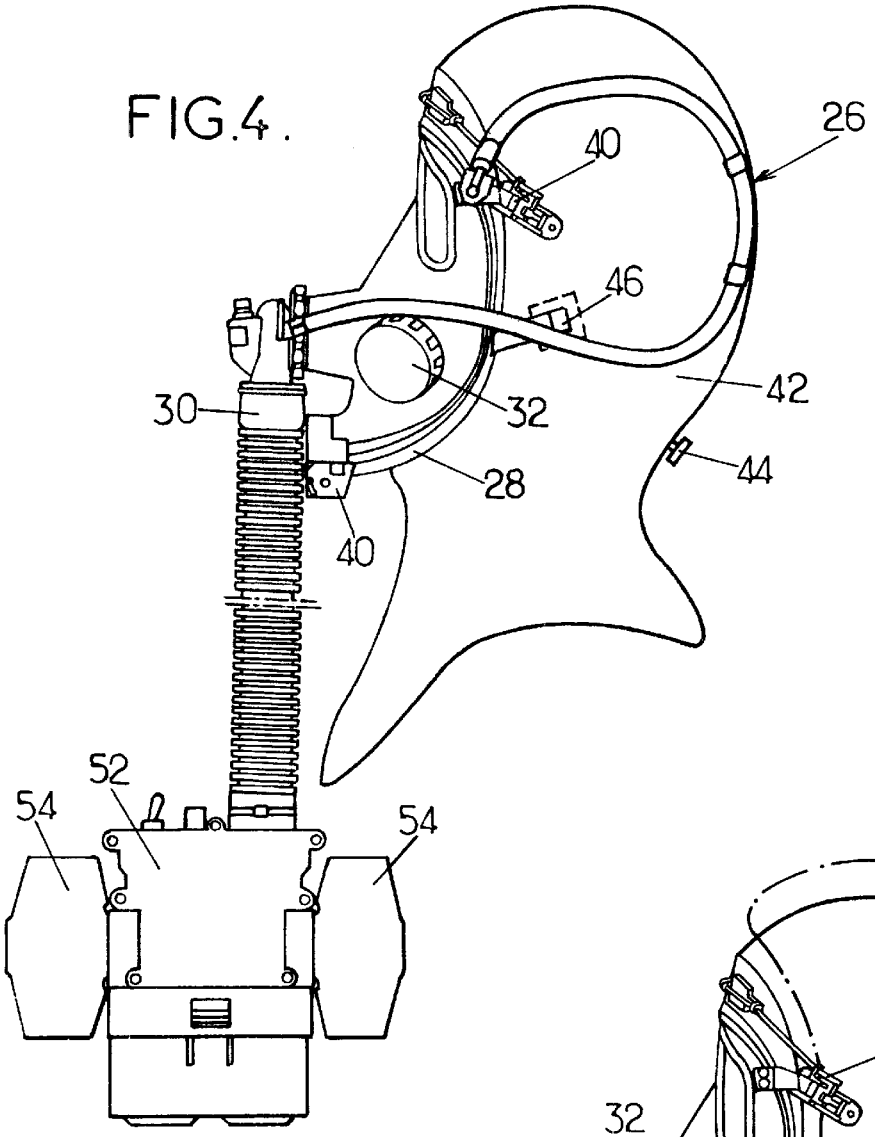
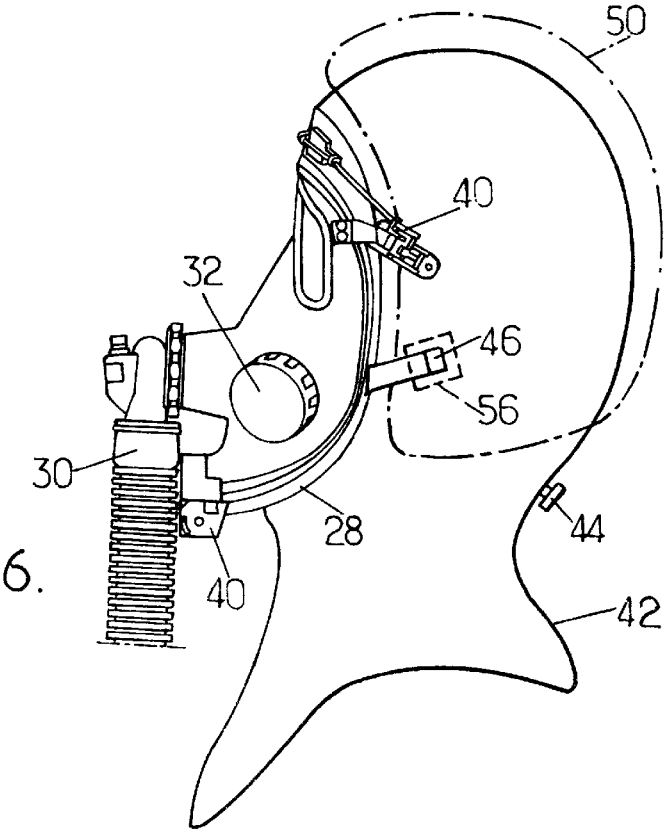
FIG.6.

DEVICE FOR PROVIDING PROTECTION AGAINST HYPOXIA, USABLE IN A HOSTILE ENVIRONMENT

BACKGROUND OF THE INVENTION

The present invention relates to a device for providing protection against hypoxia and smoke, the device comprising a mouth-and-nose breathing mask fitted with a demand regulator, optionally accompanied with smoke-protection goggles, and designed to be fed from a source of oxygen and to dilute the oxygen with air taken from the environment when the ambient pressure does not require a pure oxygen feed.

To protect crew members of a fixed wing or rotary wing aircraft fitted with such a device or headgear against NBC (nuclear-biological-chemical) attack proposals have already been made to associate the device with a hood surrounding the head and the neck, and apt to be sealingly connected to the mask.

That solution is not entirely satisfactory. In the event of an NBC threat, crew members must wear their hoods from the beginning of a mission that runs the risk of NBC attack, and under the best of circumstances such hoods have small openings and are very uncomfortable, even when there is no need to wear a breathing mask, e.g. at low altitude.

Also known are protection devices for use on the ground or at low altitude, comprising a face cover which surrounds the eyes and is fitted with means for being put in place on the face and for being held on, and also including a mouth-and-nose mask fitted with an admission coupling for breathing gas (generally filtered air provided by a blower) and a breathe-out valve leading to the atmosphere thorough the face cover. On its own, such a device does not provide adequate protection against NBC attack, to which aircraft pilots, and in particular the pilots of helicopters and transport airplanes, may be subject.

SUMMARY OF THE INVENTION

An object of the present invention is to provide a device for protection against hypoxia and smoke which can be used either separately where there is no NBC risk, or else in combination with a hood which, when worn on its own (e.g. during periods of flight at low altitude) is much less uncomfortable than conventional hoods.

To this end, there is provided a device having:

- a face cover provided with a flexible gasket surrounding the eyes to protect them against smoke, sealing means at its periphery, and a closable coupling to a filtered air feed;
- a mouth-and-nose (oronasal) mask placed in the face cover, fixed thereto, and fitted with a demand regulator whose inlet is provided with a coupling to an oxygen feed source and whose exhaust is connected directly to atmosphere through the face mask via an exhaust valve, the breathe-in and breathe-out paths in the regulator being separated by partitions ; and means for retaining the face cover on the face of a wearer.

Such a device can include a conventional demand regulator suitable for being fed from an oxygen supply ; the core thereof is retained, and is associated with a mask fitted with a face gasket.

The breathe-in portion of the regulator, inside the partition or case which defines the breathe-in path, is generally connected to internal ventilation means of the face cover, enabling the volume around the head to be ventilated.

When such a device is used for missions on which there is no NBC threat, it is possible to provide the face cover with means for donning and holding the mask on the face, which comprise an inflatable harness and a block removably secured to the front face of the face cover. The device can then be put into place in conventional manner. The harness can be designed to be usable by crew members regardless of whether they are wearing helmets, as described in document FR-A-2 710 272 or U.S. Pat. No. 5,488,948.

In a modified embodiment, suitable when the risk of hypoxia and smoke is the only expected risk and providing the pilot is wearing a helmet, a hoop can be fixed to the helmet using the prongs which are conventionally used for securing a mask. Under such circumstances, the hoop should be designed to receive the face cover in sealed manner. The face of the pilot is then exposed to the environment, with the exception of the breathing passages and the zone surrounding the eyes which are protected by flexible gaskets. Under such circumstances, a harness is unnecessary.

In contrast, when there exists an NBC risk, the crew members put on their hoods before the start of the mission. Conventionally, such a hood has a portion enveloping the head and provided with a neck gasket, and a portion that forms a bib which extends over the flying suit. Unlike conventional hoods, a hood designed to be used with a device of the kind described above can include a very large opening leaving uncovered the mouth, the nose, and the eyes. A hood of this kind is not as uncomfortable to wear as are conventional hoods.

An air-tight chamber must be established around the heads of crew members when an NBC threat is present. The device described above makes it possible to adopt various solutions to establish such a sealed enclosure. NBC protection may be provided in particular by generating an over pressure in the pilot's head volume.

One solution consists in fitting the hood with a hoop of the kind described in U.S. patent application Ser. No. 09/072188, said hoop being secured by prongs which engage in receptacles in the helmet. Under such circumstances, the face cover can be designed to be fixed on the hoop, using means which may be as described in that patent application.

The breathe-in path of the demand regulator is typically connected to ventilation means inside the face cover, which may be constituted by two pipes opening out inside the face cover. The mask can be fed with filtered air when there is no need for oxygen enrichment. A filtered air feed is provided under small over pressure so as to sweep through the hood and/or the helmet, thereby putting the head enclosure under pressure.

The above features and others appear more clearly on reading the following description of particular embodiments, given by way of non-limiting example. The description refers to the accompanying drawings.

BRIEF DESCRIPTION OF THE DRAWINGS

FIG. 4 shows from the device can be used under NBC conditions by a crew member not wearing a helmet;

FIG. 6 is similar to FIG. 4 and shows how the device can be used in NBC conditions in association with a helmet.

DETAILED DESCRIPTION

Figure 1:
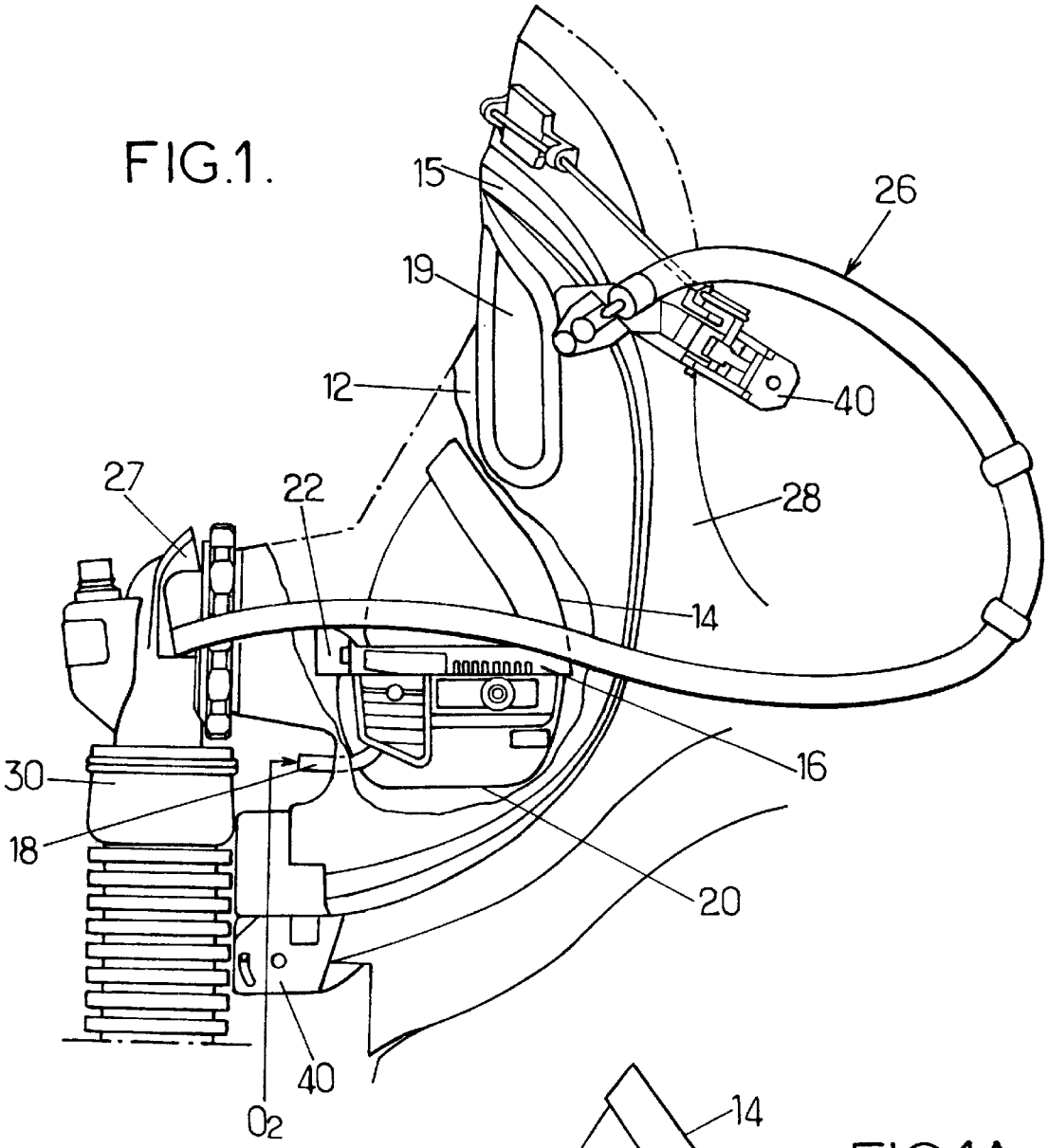
FIG. 1 is a cutaway elevation view showing one possible structure for a device suitable for use under conditions that do not imply an NBC threat.
Figure 1A:
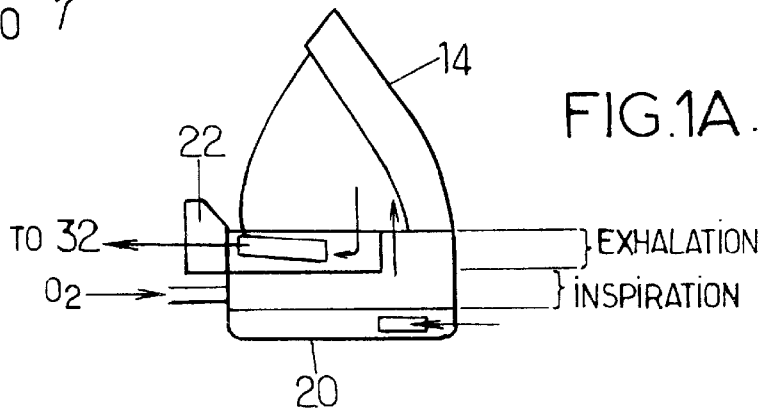
FIG. 1A is a schematic elevation view showing the connections of the mask of the device in FIG. 1.
Figure 2:
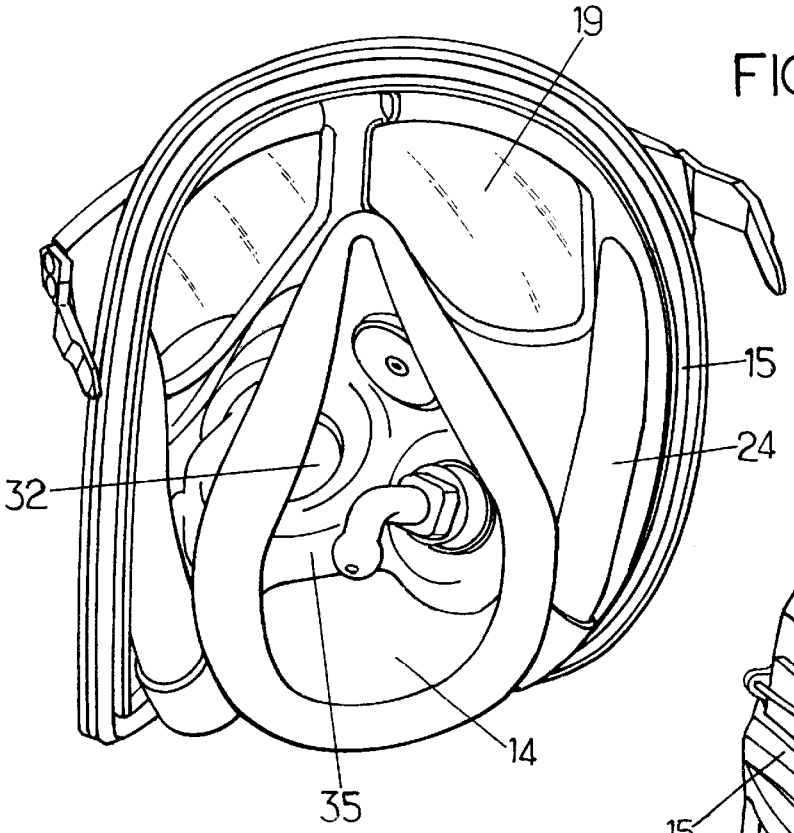
FIG. 2 is an inside view of the face cover, shown in perspective.
Figure 3:
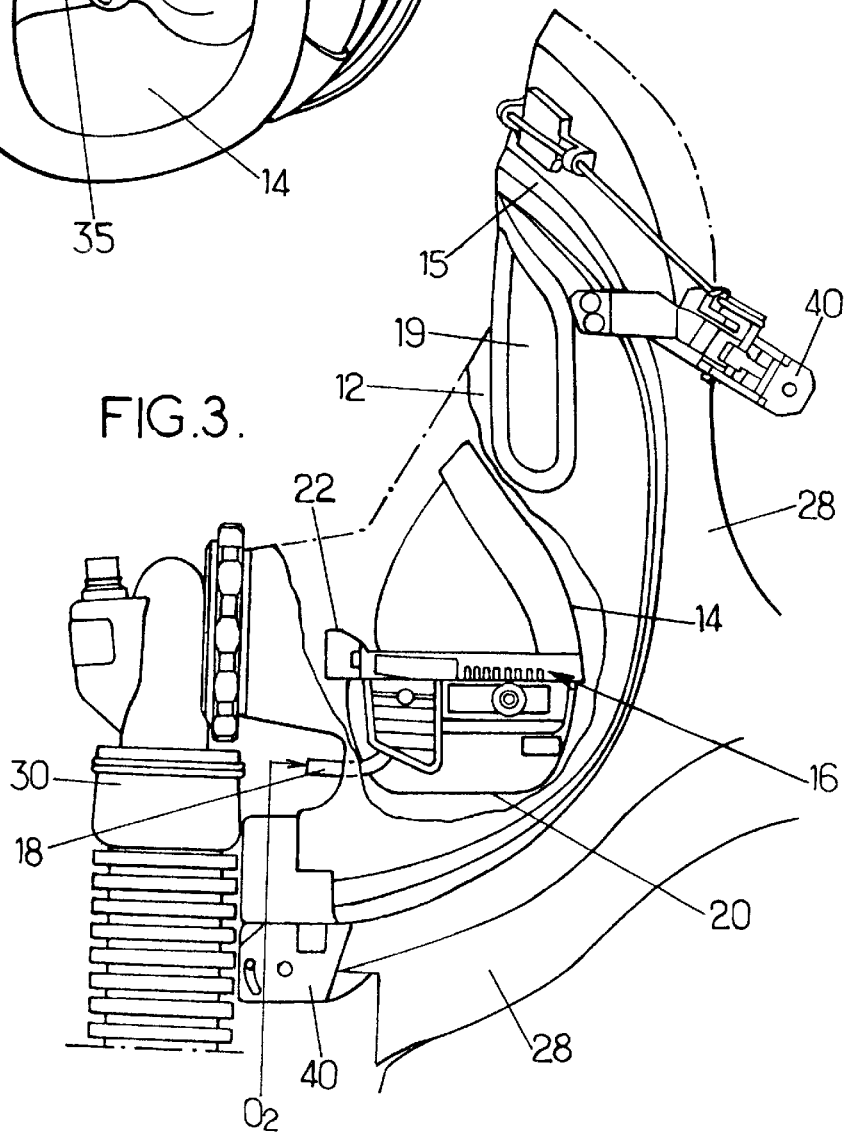
FIG. 3 is an elevation view similar to FIG. 1, showing the device in place on a helmet hoop.

The device shown in FIGS. 1 and 2 comprises a face cover 12 containing a mouth-and-nose mask 14 and a face gasket 15. The face cover 12 has one or more breathe-out valves 32, an endpiece 30 for connection to an air feed hose and provided with a non-return valve 33, and optionally a drinking liquid feed endpiece 35 placed symmetrically to the valve 32 about the vertical midplane of the face cover. The face cover also includes a flexible gasket 15 designed to have an air-tight connection with a hoop, as described below.

The face cover has an eye shield or transparent goggles 19 surrounded by a flexible gasket apt to be pressed against the face and to define a protective enclosure around the eyes.

The mouth-and-nose mask 14 is carried by the face cover 12. It is fitted with a demand regulator 16 whose inlet is provided with a coupling 18 for coupling to an oxygen feed source, and whose exhaust is connected to the atmosphere through the face cover via the breathe-out valve 32. The breathe-in and breathe-out paths through the regulator 16 are separated by respective cases or partitions 20 and 22.

The breathe-in portion of the regulator, inside the case 203 defining the breathe-in path, is generally connected to internal ventilation means of the face cover, opening out into a pipe 24 for ventilating the head (FIG. 2).

The front face of the face cover shown in FIG. 1 is designed, to receive an inflatable harness 26 for rapidly donning, having a block 27 that can be coupled to the front face of the face cover. The device can be used with such a harness for missions in which there is no NBC threat.

The harness may be designed to be usable by crew members wearing helmets. The sealing gasket can then bear against a hoop 28 of the kind described in U.S. patent application Ser. No. 09/072188. When provided, that hoop can be removably secured to the helmet by lateral prongs 30.

The harness can also be removed or omitted. The face cover can then be provided with means for three-point fixing on a hoop 28 such as those described in French Patent Application No 97/05566 co-operating with receptacles 40 fitted to the hoop, or else provided with prongs when there is no hoop.

There is no need to couple the endpiece 30 to a filtered feed under such conditions of use; dilution, when necessary, is performed using ambient air.

Figure 5:
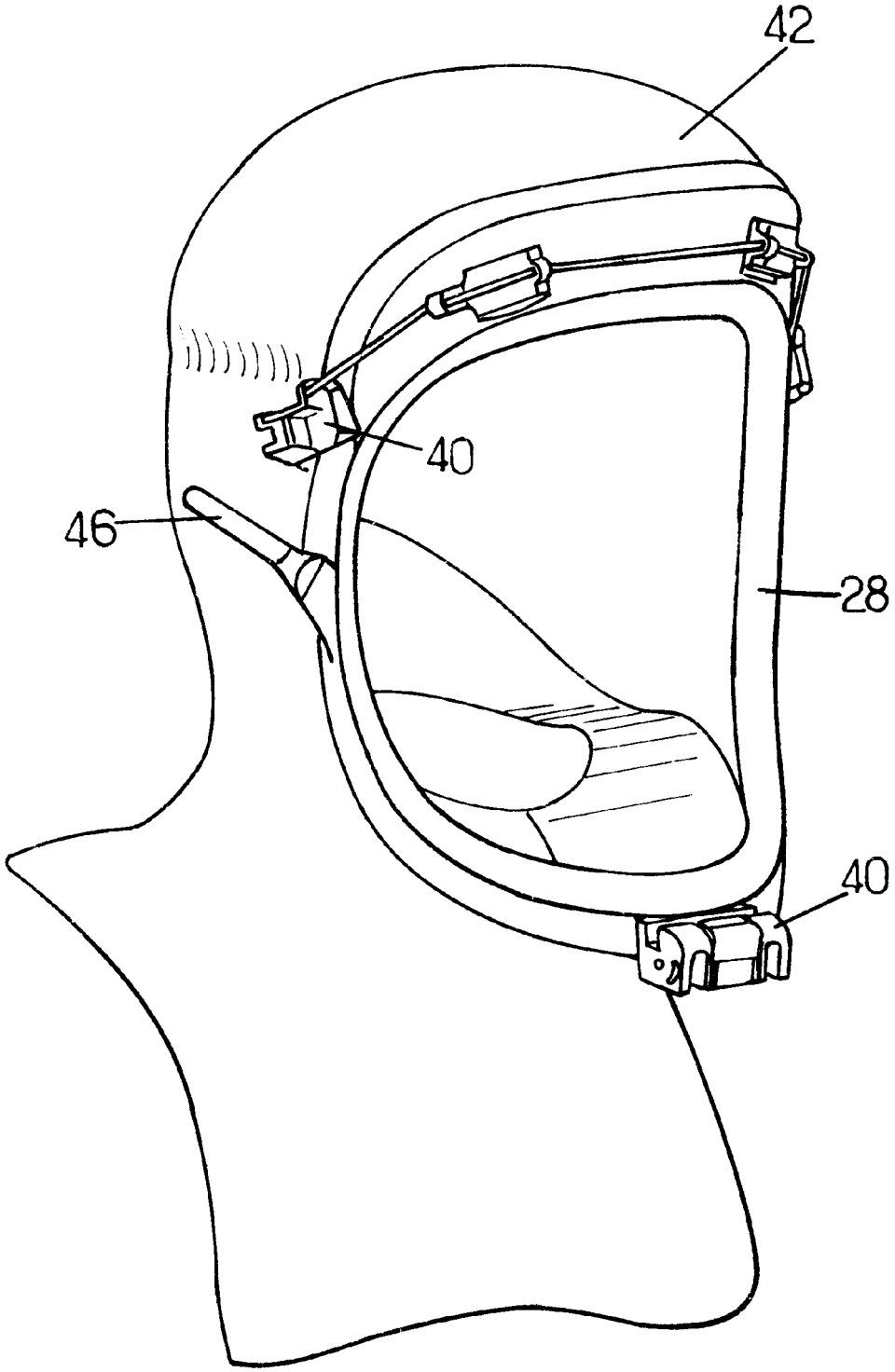
FIG. 5 shows a hood provided with a hoop and usable under the conditions of use shown in FIGS. 4 and 6.

On the contrary, where there is an NBC risk, crew members put on their hoods before the start of a mission, and connect the endpieces 30 to a filtered air feed. If a mission does not require a helmet to be worn, then the face cover can be designed to connect directly to a hoop which is permanently fixed to the hood. FIGS. 4 and 5 show such a hood 42 provided with an exhaust valve 44 and a hoop 28. The hoop which is sealingly fixed to the hood defines an opening of large size, which is favorable from the point of comfort.

As shown, the hoop 28 has three receptacles 40 for receiving retainers of a face cover, and lateral racks or bayonets 46, for fitting to a helmet.

When the person to be protected must wear a helmet 50 (FIG. 6), as is the case for pilots, for example, then the hoop of the hood is connected to the helmet by racks 46 which engage in receptacles 56. The face cover is fixed to the hoop only when necessary, by being coupled to the receptacles 40.

It is possible to remove the racks or helmet, when not required, merely by releasing the bayonets 46.

The filtered air feed means may conventionally comprise a blower 52 fitted with admission filters 54 and providing a flow rate sufficient for breathing and for raising the relative pressure inside the hood. The blower may feed one or more face covers. It is connected to the on-board network or is fed from an independent supply.

What is claimed is:

1. A device for providing protection of a wearer in a hostile environment, comprising:

a face cover provided with an eye shield and having a peripheral flexible gasket adapted to surround a wearer's face, and further having an air coupling for connection to a filtered air feed;

a mouth-and-nose mask placed entirely within the face cover, affixed to the face cover and having sealing means at a periphery of said mask adapted for contacting the face of the wearer and for defining an inside volume around a mouth and nose of the wearer;

a demand regulator carried by said mask, having an inlet provided with an oxygen coupling for connection to an oxygen feed source and connected to receive said filtered air feed originating from said air coupling and said face cover;

a hood adapted to surround a wearer's head, having an opening which is sized and adapted for exposing the wearer's face to atmosphere and which said hood is arranged to sealingly receive the gasket of the face cover;

an exhaust path communicating said inside volume of the mask to atmosphere through the regulator and then a breathe out valve on the face cover;

partition means for separating a breathe-in path and a breathe-out path within the demand regulator, and means adapted for removably holding the mask on the face of the wearer and the gasket of the face cover in air tight contact with the hood.

2. A device according to claim 1, wherein the hood has a hoop surrounding the opening, designed to receive the gasket of the face cover, and is provided with receptacles belonging to said means for removably holding the mask.

3. A device according to claim 2, wherein said hoop is provided with connecting means arranged for engagement into receptacles provided on the helmet and securing said hoop to said helmet.

4. A device for providing protection to a wearer in a hostile environment, comprising:

a face cover adapted to surround a wearer's face and to protect eyes of the wearer, having sealing means at a periphery thereof and having a coupling for connection with a filtered air feed;

a hood adapted to surround a head of the wearer in direct contact with the head of the wearer, having a single opening surrounded by a hoop sized and adapted for leaving free access of a wearer's face to atmosphere, said hoop being designed to sealingly receive said sealing means of the face cover;

a mouth-and-nose mask placed in the face cover, provided with a demand regulator having means for connection of a source of breathable gas to said demand regulator and having means for exhausting directly to atmosphere from said regulator through an exhaust valve on said face cover and partition means for defining separate breathe-in and breathe-out paths within said regulator, and means for removably connecting the face cover to said hoop, thereby holding the mouth-and-nose mask and the face cover in place on the wearer.

5. A device for providing protection to a crew member of an aircraft in a hostile environment, comprising:

removable helmet adapted for covering a crew member's head;

a face cover adapted to surround a crew member's face and to protect eyes of the crew member, said face cover having sealing means at a periphery thereof and having a closable coupling for connection with a filtered air feed;

a hood adapted to surround the crew member's head in direct contact with the head of the wearer, said hood having an opening defined by a hoop sized and adapted for exposing the crew member's face to atmosphere, said hoop being arranged to sealingly receive said sealing means of said face cover and having means for releasable connection of the hoop to the helmet;

a demand regulator carried by the mask, having an inlet for connection with an oxygen source, an exhaust connected directly to atmosphere through said face cover and a breathe out valve and a connection with said mask for delivery of regulated breathing gas to said mask breathe-in and breathe-out paths in said regulator being separated by partitions; and means for connecting the hoop to the helmet and retaining the face cover and mask on the crew member's head.

6. A device for providing protection to a wearer in a hostile environment, comprising:

a movable helmet for covering a head of the wearer;

a face cover adapted to surround a wearer's face and to protect eyes of the wearer, said face cover having sealing means at a periphery thereof and having a closable coupling for connection with a filtered air feed;

a hood adapted to surround the head of the wearer in direct contact with the head of the wearer, said hood having an opening defined by a hoop sized and adapted for leaving free a mouth, a nose, and the eyes of the wearer, said hoop being arranged to sealingly receive said sealing means of said face cover and having means for releasable connection of the with the helmet;

a demand regulator carried by the mask, having an inlet for connection with an oxygen source, an exhaust connected directly to atmosphere through said face cover and a breathe out valve and a connection with said mask for delivery of regulated breathing gas to said mask; and means for connecting the hoop to the helmet and retaining the face cover and mask on the wearer's face.

* * * * *